US005394667A

United States Patent [19]

Nystrom

[11] Patent Number: 5,394,667

[45] Date of Patent: Mar. 7, 1995

[54] FLOORING CONSTRUCTION AND METHOD

[76] Inventor: Ron Nystrom, 7216 Backlick Rd., Springfield, Va. 22153

[21] Appl. No.: 24,360

[22] Filed: Mar. 1, 1993

[51] Int. Cl.[6] ..... E04B 9/00

[52] U.S. Cl. ..... 52/480; 52/263; 52/730.7

[58] Field of Search ..... 52/480, 665, 715, 509, 52/489, 765, 481, 482, 483, 730.7, 263; 411/508, 509, 510, 913

[56] References Cited

U.S. PATENT DOCUMENTS

Re. 5,515 7/1873 Wands .
168,672 10/1875 Reed .
239,846 4/1881 Ring .
482,536 9/1892 Zagelmeyer .
582,645 5/1897 Heaton .
1,045,219 11/1912 Tramill .
1,260,531 3/1918 Fiala .
1,302,578 5/1919 Murphy .
1,407,679 2/1922 Ruthrauff .
1,593,297 7/1926 Gilmer .
1,693,655 12/1928 Murphy .
1,699,074 1/1929 Loucks .
1,898,364 2/1933 Gynn .
1,931,709 10/1933 Schaffert .
1,941,211 12/1933 Inglee .
2,038,433 4/1936 Lawrence, Jr. .
2,094,910 1/1937 Baily .
2,571,603 10/1951 Payzant .
3,136,530 6/1964 Case .
3,217,453 11/1965 Medow .
3,267,630 8/1966 Omholt .
3,287,203 11/1966 Elmendorf .
3,299,601 1/1967 Chiville .
3,393,488 7/1968 Schneller .
3,553,919 1/1971 Omholt .
3,590,541 7/1971 Epstein et al. .
3,613,327 10/1971 Hall .
3,713,264 1/1973 Morgan .
3,724,154 4/1973 Cookson .
3,786,608 1/1974 Boettcher ..... 52/480
3,789,557 2/1974 Harvey .
3,820,293 6/1974 Ohe et al. .
3,921,356 11/1975 Hughes .
3,971,181 7/1976 Zetlin .
4,117,644 10/1978 Weinar .
4,164,832 8/1979 Van Zandt .
4,189,881 2/1980 Hawley .
4,220,099 9/1980 Marchesano .
4,229,919 10/1980 Hughes .
4,313,688 2/1982 Daniels .
4,384,621 5/1983 Bitzel .
4,395,858 8/1983 Gwyther .
4,448,007 5/1984 Adams .
4,481,749 11/1984 Stirling .
4,525,971 7/1985 Kern .
4,528,783 7/1985 Muir ..... 52/509 X
4,580,386 6/1986 Hemphill .
4,620,403 11/1986 Field ..... 52/480
4,622,792 11/1986 Betts .
4,658,562 4/1987 Brugman .
4,823,529 4/1989 Canfield et al. .
5,022,200 6/1991 Wilson .
5,027,573 7/1991 Commins .
5,031,369 7/1991 Kobayashi et al. .
5,059,474 10/1991 Yoshida .

*Primary Examiner*—Carl D. Friedman
*Assistant Examiner*—Creighton Smith
*Attorney, Agent, or Firm*—Dennis H. Lambert

[57] ABSTRACT

A flooring system in which flooring boards are held to an underlying support structure by use of clips that eliminate the need for fasteners extended through the flooring boards. In a preferred form of the invention, the clips have a barbed projection that is adapted to extend into a groove formed in the bottom of the flooring board to grip the board and hold it to the support structure. With this form of the invention flooring boards may be secured to a support structure simply by fastening the clips to the support structure and then pressing the boards into place on the clips. In another form of the invention, the clip is slidably attached to the support structure so that it can slide along the support structure, thereby enabling the boards to be moved toward one another after assembly to the support structure for reducing any gaps or spaces between adjacent boards.

12 Claims, 7 Drawing Sheets

FIG. 10
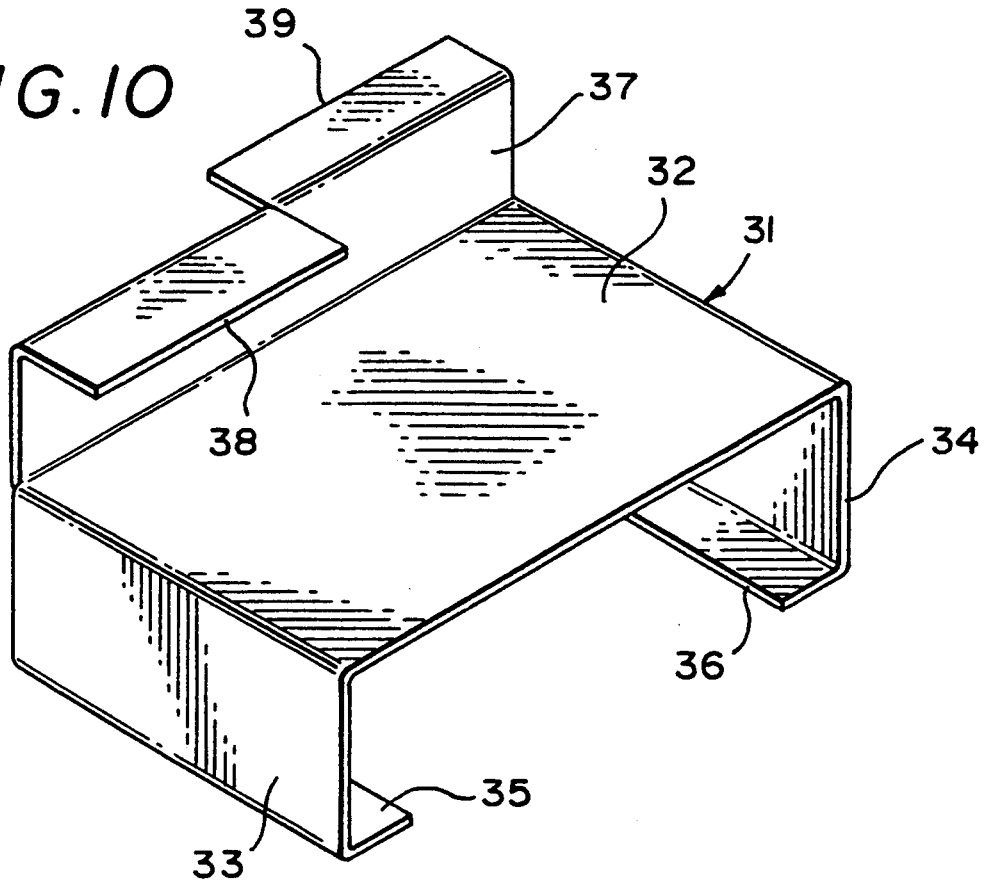
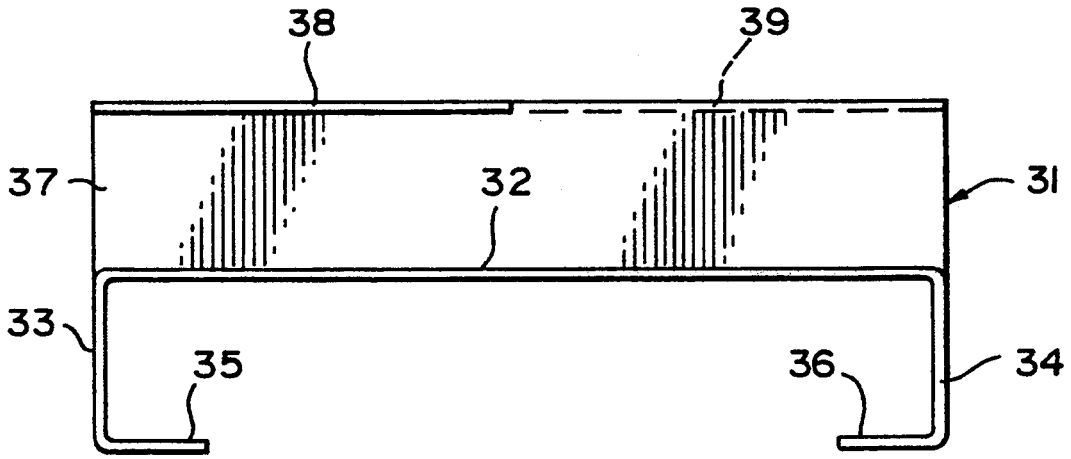
FIG. 11

FIG. 12
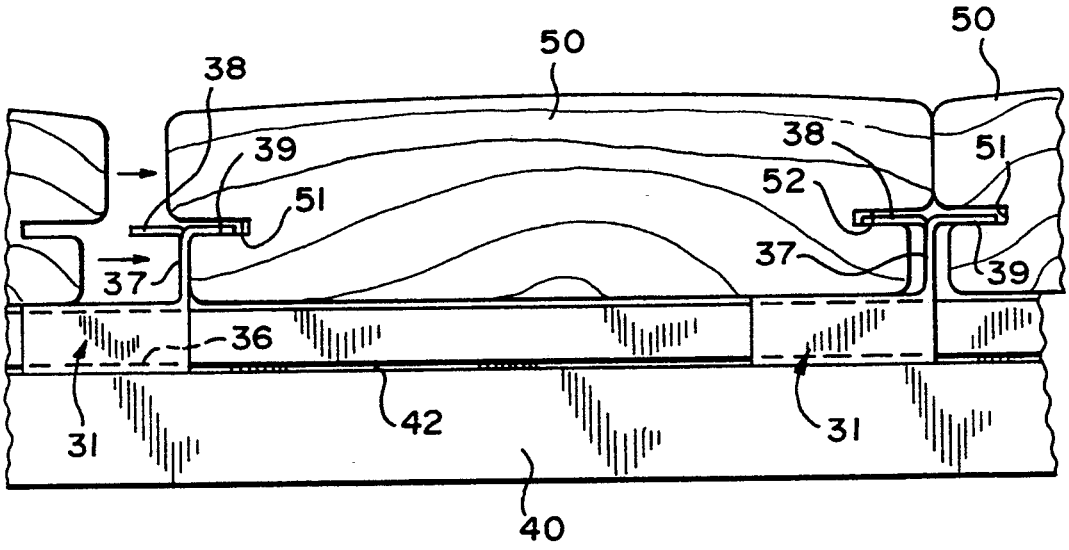
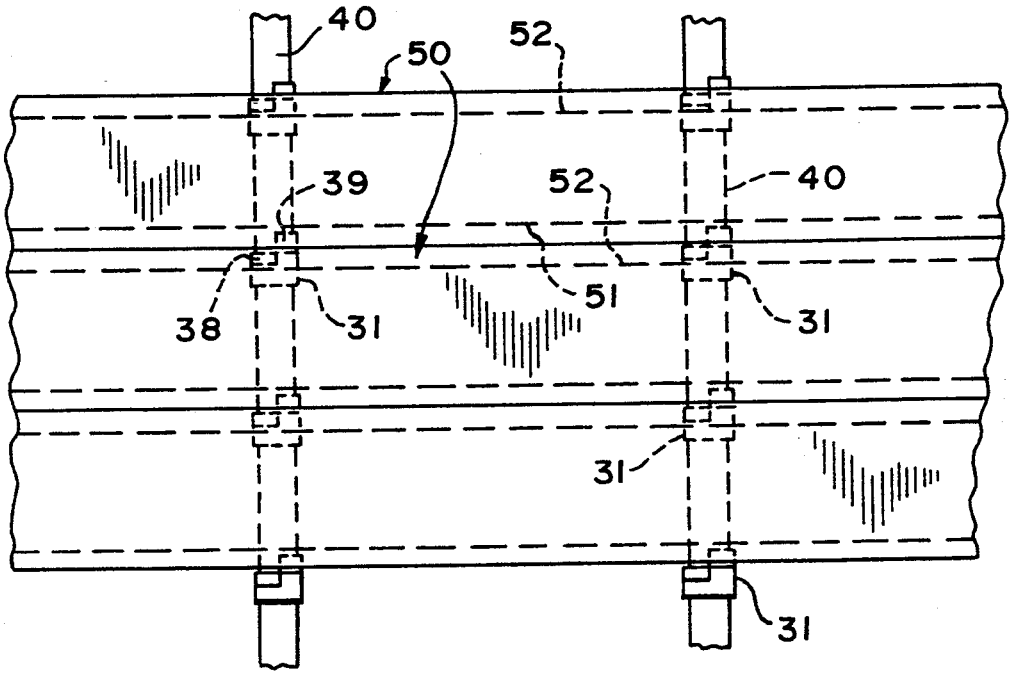
FIG. 13

FLOORING CONSTRUCTION AND METHOD

TECHNICAL FIELD OF THE INVENTION

This invention relates to building constructions. More particularly, the invention relates to unique fastening clips and complementary building components, such as deck boards, for use in constructing a floor or other structure, and to a construction assembly and method.

BACKGROUND OF THE INVENTION

Conventional building construction techniques, especially in the construction of a deck or floor surface, rely upon the use of nails or screws and the like passed downwardly through the exposed face surface of the decking or flooring boards and into an underlying support or frame for securing the boards to the frame. This method is not only time consuming, but results in a flooring surface that is blemished by the exposure of many fasteners extended through the top surface of the floor. Moreover, in exterior deck constructions these exposed fasteners provide numerous small traps for collecting and holding water, and define channels for flow of water into and through the boards, thus accelerating deterioration of the decking. Further, the nails used to fasten exterior decking boards tend to work loose over time, becoming raised above the deck surface and creating a safety hazard.

Exterior decking boards also are generally constructed from chemically treated dimension lumber having planar top and bottom surfaces. As these boards dry out over time, they shrink and tend to warp or cup on their upper surface, forming shallow pockets which trap water. This standing water trapped on the top surface of the boards accelerates deterioration of the boards and promotes further cupping, checking and cracking of the boards.

Moreover, conventional decking boards lie flat against the underlying support structure, e.g., floor joists, and with the floor joists define a plurality of separate bays or chambers at the bottom surface of the boards. The full contacting engagement between the boards and joists effectively block flow of air beneath the boards from one bay or chamber to the other, resulting in uneven temperature differentials between adjoining bays and especially from the top surface to the bottom surface of the boards. This lack of air circulation results in non-uniform drying of the boards, further promoting checking, cracking and cupping of the boards.

Additionally, when conventional decking boards are stacked on top of one another for storage they are in substantially full contact with one another over their adjoining surfaces. This full contact between the boards in a stack essentially completely blocks circulation of air around the boards in the stack and results in very slow drying of boards in the second and subsequent layers from the top of a stack.

When lumber is chemically treated to make it resistant to weather and attack by insects, the added moisture resulting from the treatment process causes the lumber to swell. After the lumber has been installed to construct a flooring surface or the like, this added moisture dries out of the lumber causing it to shrink back to its original, milled size. This shrinkage causes the installed boards to separate from one another, sometimes forming unsatisfactorily large cracks or joints between adjacent boards. With conventional construction techniques there is no remedy except to detach the boards and reassemble them more closely together.

A variety of different building components, fastening clips, brackets and the like have been devised in the prior art in an effort to solve some of the problems associated with flooring constructions as discussed above. Some of these constructions require the use of additional supporting structure or adapters that are shaped to accommodate the clips, and/or require that fasteners such as nails and the like be extended into the flooring boards either through the clips or separately therefrom to properly secure the boards. Further, some of the prior art clip designs do not remain properly engaged with the board when the board dries out and shrinks following installation, and do not permit the shrunken boards to be repositioned more closely together after they have dried. Still other prior art clip designs are complicated to make and use and are relatively expensive.

Accordingly, there is need for a simple and inexpensive construction that uses a clip for securing two or more building components together, and especially in the construction of flooring, wherein separate fasteners are not required to be engaged with the flooring material to secure it in place.

Further, there is need for an assembly clip that permits repositioning of flooring boards after they have dried and shrunk away from one another following installation.

DESCRIPTION OF THE INVENTION

In accordance with the present invention, a construction assembly is provided that uses a clip to secure a first building component to a supporting structure without requiring any separate fasteners to be extended into the first building component, and in accordance with one form of the invention permits the boards to be repositioned if they dry and shrink away from one another following installation.

The construction assembly of the invention is simple and economical to make and use, and especially facilitates the construction of a flooring surface such as a deck floor or the like, although it could also be used to secure panels or other building components to a supporting surface and/or to one another.

In a preferred form of the invention, the assembly includes a clip adapted to secure a first building component, such as a decking board or the like, on top of supporting floor joists by simply pressing the board downwardly over a clip that has been previously installed on top of the floor joist. In another form of the invention, the clip is installed either directly on top of supporting floor joists or on top of an adapter rail or stringer placed on top of the joists, and the clip is longitudinally slidable with respect to both the boards and the joists or stringers so that the boards may be repositioned following installation.

The clip in the preferred form of the invention has an elongate body adapted to be secured on the supporting surface, with barbed projections on opposite sides for engagement in complemental grooves on the undersurface of a decking board, for example, to be secured to the supporting surface. In use, the clip is secured to the supporting surface by one or more suitable fasteners extended through it and into the supporting surface, and the decking board to be secured thereby is then placed over the clip, with grooves in the decking board aligned with the clip. The decking board is then pressed downwardly over the clip, or a series of aligned clips, so that the barbed projections are engaged in the grooves and the decking board thereby secured to the supporting surface.

In the second form of the invention, the clip has a first pair of opposed retaining flanges adapted to slidably engage in slots on opposite sides of a floor joist or stringer placed on top of the floor joists, and a second pair of opposed retaining flanges oriented in a direction disposed at 180° to the first pair of flanges and adapted to slidably engage in grooves on opposite sides of a decking board placed transversely on top of the joists. In this form of the invention the boards may be slid longitudinally of the joists following installation to thereby tighten the joints between adjacent boards.

Both forms of the invention provide a quick and easy assembly method for securing one building component to another building component, and especially for securing decking to a support structure. A deck floor constructed in accordance with the invention is free of unsightly fasteners extended through its exposed face surface, and is enabled to expand and contract upon gain or loss of moisture without excessive stress being induced therein, thereby prolonging its life.

Further, in a preferred form of the invention the decking boards have a convex top surface with a predetermined radius of curvature designed to shed water and yet to provide a comfortable surface on which to stand and walk, and spaces are provided in the undersurface of the boards to permit circulation of air when the boards are stacked and when they are installed on a supporting structure, thereby promoting more rapid and uniform drying.

BRIEF DESCRIPTION OF THE DRAWINGS

The foregoing, as well as other objects and advantages of the invention will be apparent from the following detailed description when considered in conjunction with the accompanying drawings, wherein like reference characters designate like parts throughout the several views, and wherein:

FIG. 10 is an enlarged top perspective view of the fastening clip according to the second form of the invention;

FIG. 11 is an end view in elevation of the clip of FIG. 10;

FIG. 12 is a full size sectional view of the structure of FIG. 9, taken transversely to the longitudinal axis of the decking boards; and FIG. 13 is a fragmentary plan view of a portion of deck constructed in accordance with the invention shown in FIG. 9.

BEST MODE OF CARRYING OUT THE INVENTION

Figure 1:
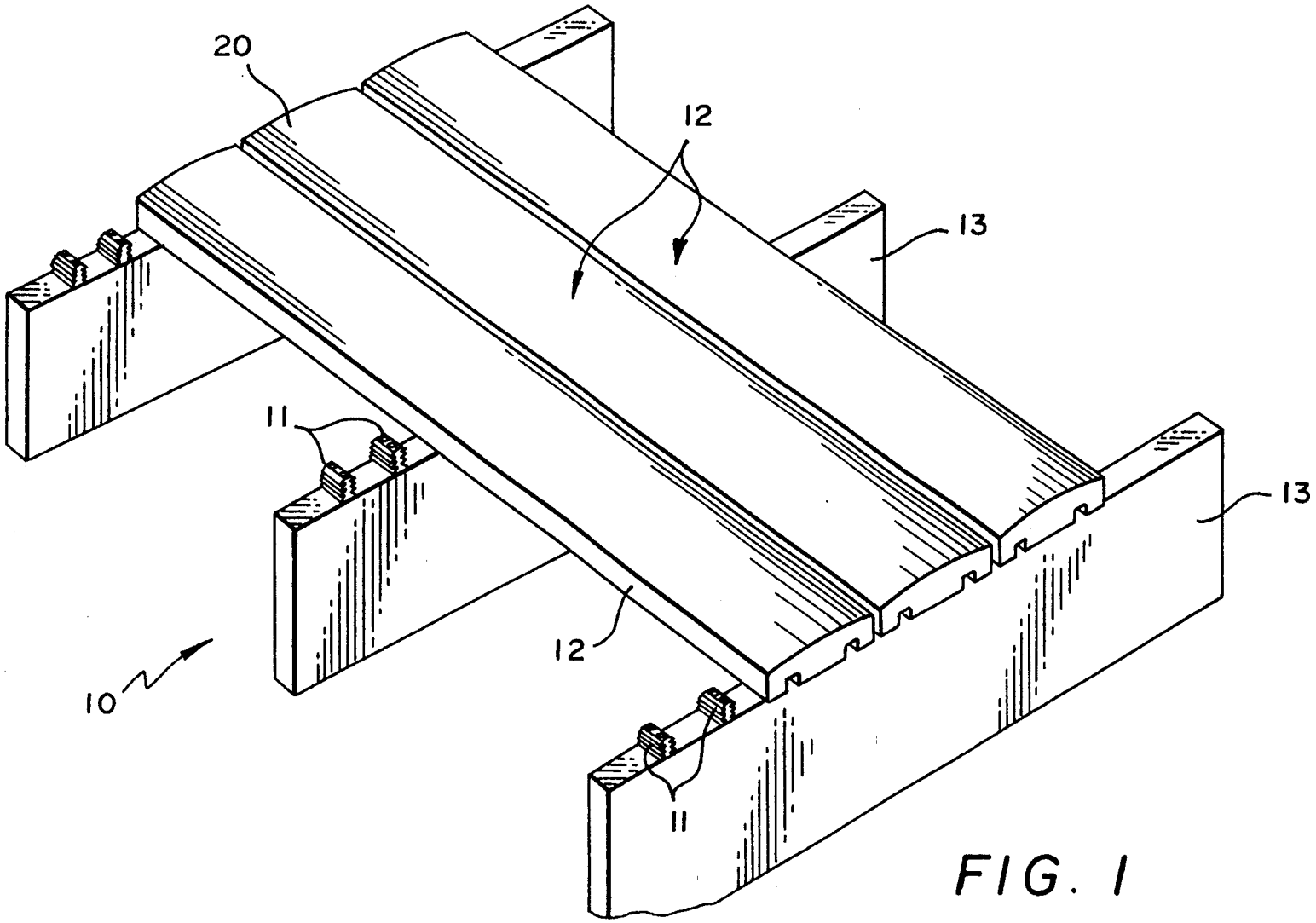
FIG. 1 is a fragmentary top perspective view of a portion of a deck constructed in accordance with a preferred form of the invention.

A preferred form of the invention is indicated generally at 10 in FIGS. 1–8. In this form of the invention, specially shaped attaching clips 11 cooperate with specially shaped decking boards 12 to secure the decking boards on an underlying support structure, such as floor joists 13.

The attaching clips 11 each comprise an elongate body 14 with a plurality of elongate, downwardly engaging barbs 15 extending along opposite sides thereof. The body 14 has one or more openings 16 formed therethrough for receiving fasteners, such as nails or screws, not shown, to secure the clip on a flat surface. In the embodiment illustrated, the clip is secured on the upper edge of a floor joist. Alternatively, the clip could be secured on any flat surface, such as a pre-existing deck. The latter structure could be used, for example, to resurface an older deck without requiring the old decking material to be removed.

Figure 2:
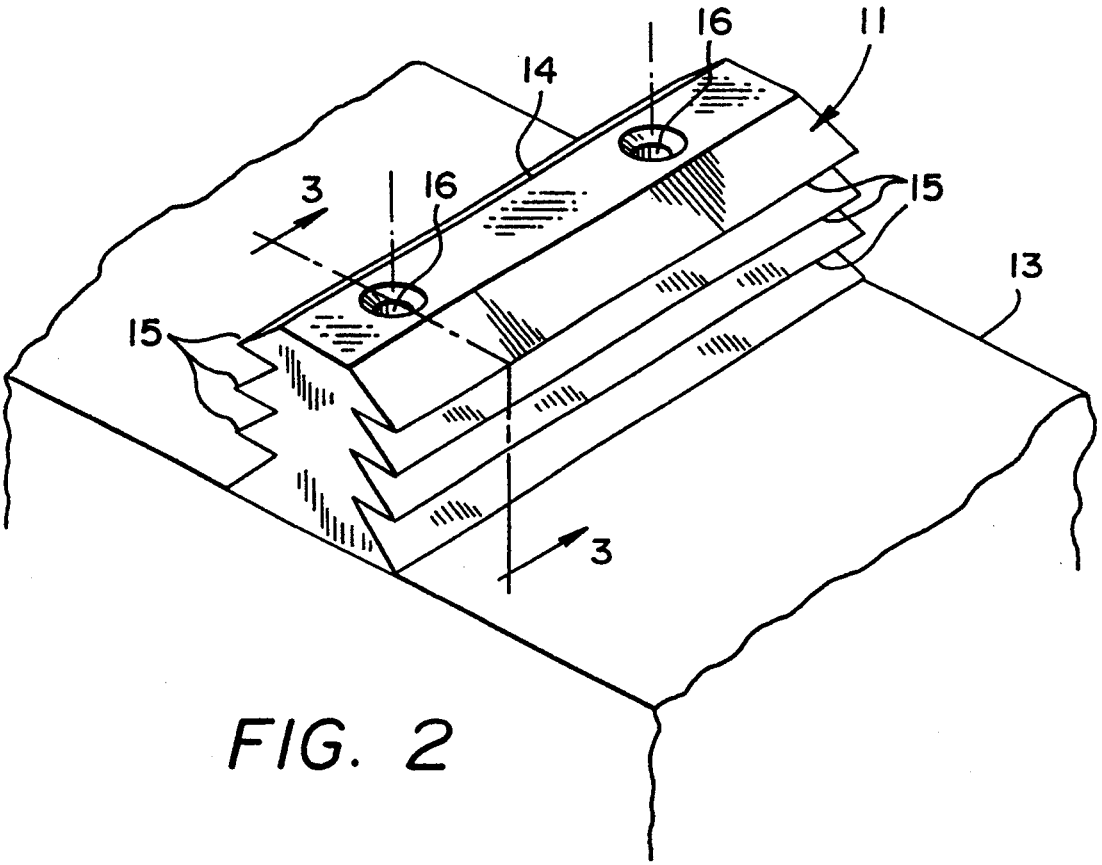
FIG. 2 is a greatly enlarged fragmentary top perspective view of a portion of a supporting structure and a fastening clip in accordance with the preferred form of the invention.
Figure 3:
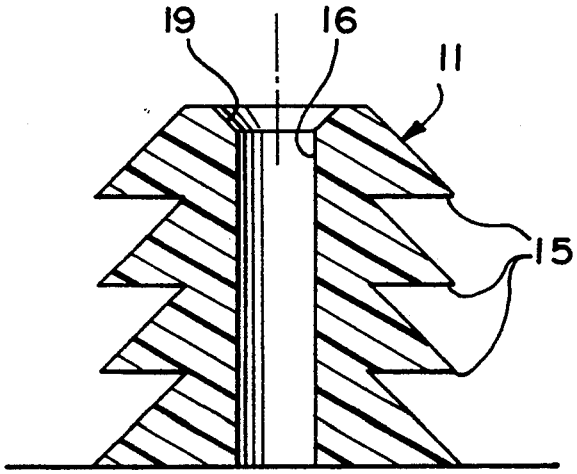
FIG. 3 is a transverse sectional view taken along line 3—3 in FIG. 2.
Figure 4:
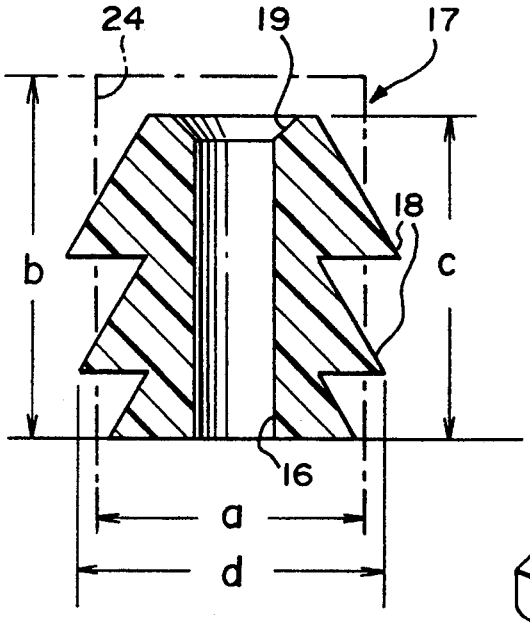
FIG. 4 is a transverse sectional view similar to FIG. 3, showing a different embodiment of clip in accordance with the preferred form of the invention.
Figure 6:
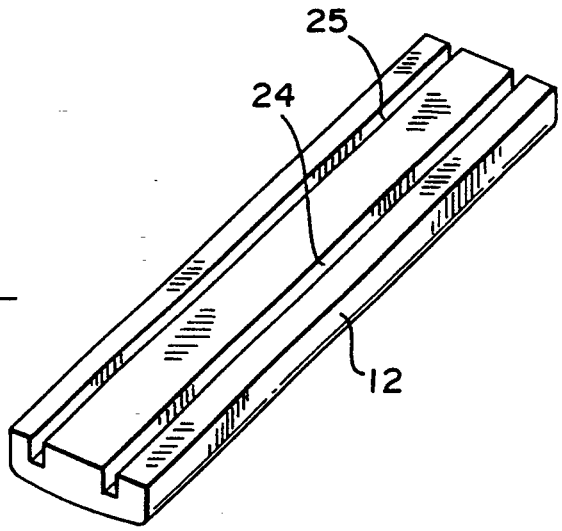
FIG. 6 is a perspective view of the bottom of the board of FIG. 5, shown on a greatly reduced scale.
Figure 5:
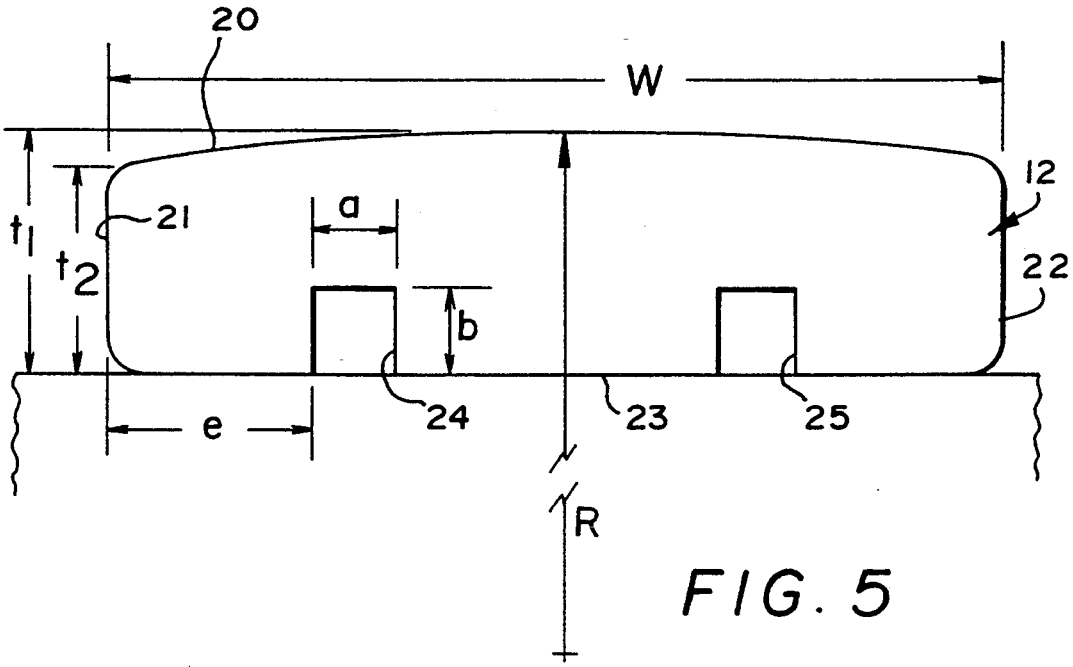
FIG. 5 is full size transverse view in section of a decking board for use with the clip of FIGS. 2, 3 and 4.
Figure 7:
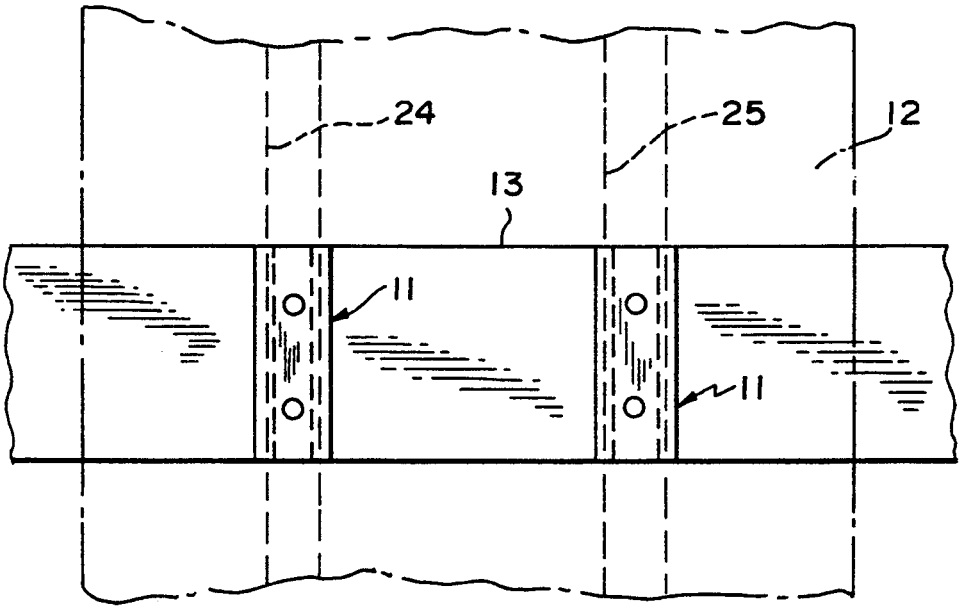
FIG. 7 is a full size fragmentary plan view of a decking board, supporting floor joist and fastening clip according to the preferred form of the invention, with the decking shown in dot-and-dash lines and extending at a right angle to the supporting floor joists.

A slightly modified attaching clip 17 is shown in FIG. 4, and is constructed and functions essentially the same as the clip 11 shown in FIGS. 2 and 3, except that it is made of plastic and the barbs 18 extend downwardly at an angle of about 60° rather than 45° as shown in FIG. 3, wherein the clip is made of metal. Only two barbs are shown in this form of the invention, but as many may be provided as desired or necessary.

The holes 16 for receiving fasteners through the clips 11 and 17 may be countersunk as at 19, if desired.

The decking boards 12 for use with the clips 11 and 17 each have a slightly rounded convex top surface 20, opposite side edges 21 and 22, and a specially configured bottom surface 23. More particularly, and as seen best in FIG. 5, the bottom surface of each board has a pair of parallel, longitudinally extending grooves 24 and 25 spaced inwardly from the side edges thereof. Each groove has a depth slightly greater than the height of the clip, and a width slightly less than the width of the projecting barbs, whereby the clip can penetrate fully into the groove and the pointed, downturned barbs will engage or bite into the sides of the grooves (see FIG. 4), resisting removal of the clips from the grooves and securely fastening the board to the joist.

In use, a series of lines or marks may be made on the joists for proper positioning of the clips to extend into the grooves on the underside of the boards to secure the boards in edge-to-edge abutting relationship to one another, and a pair of clips are secured on top of each joist where each board crosses it. A board is then placed on top of the clips in transverse, spanning relationship to the joists and simply pressed downwardly to engage the barbed clips in the grooves.

Figure 8:
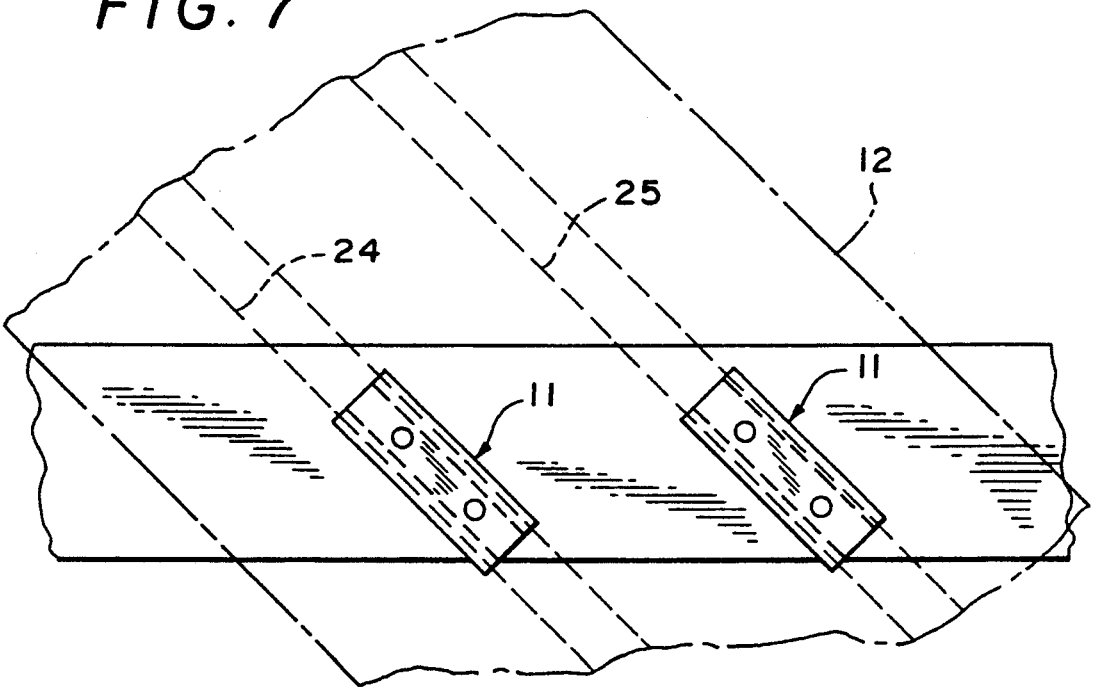
FIG. 8 is a view similar to FIG. 7, but with the decking arranged at a 45° angle to the floor joists.
Figure 9:
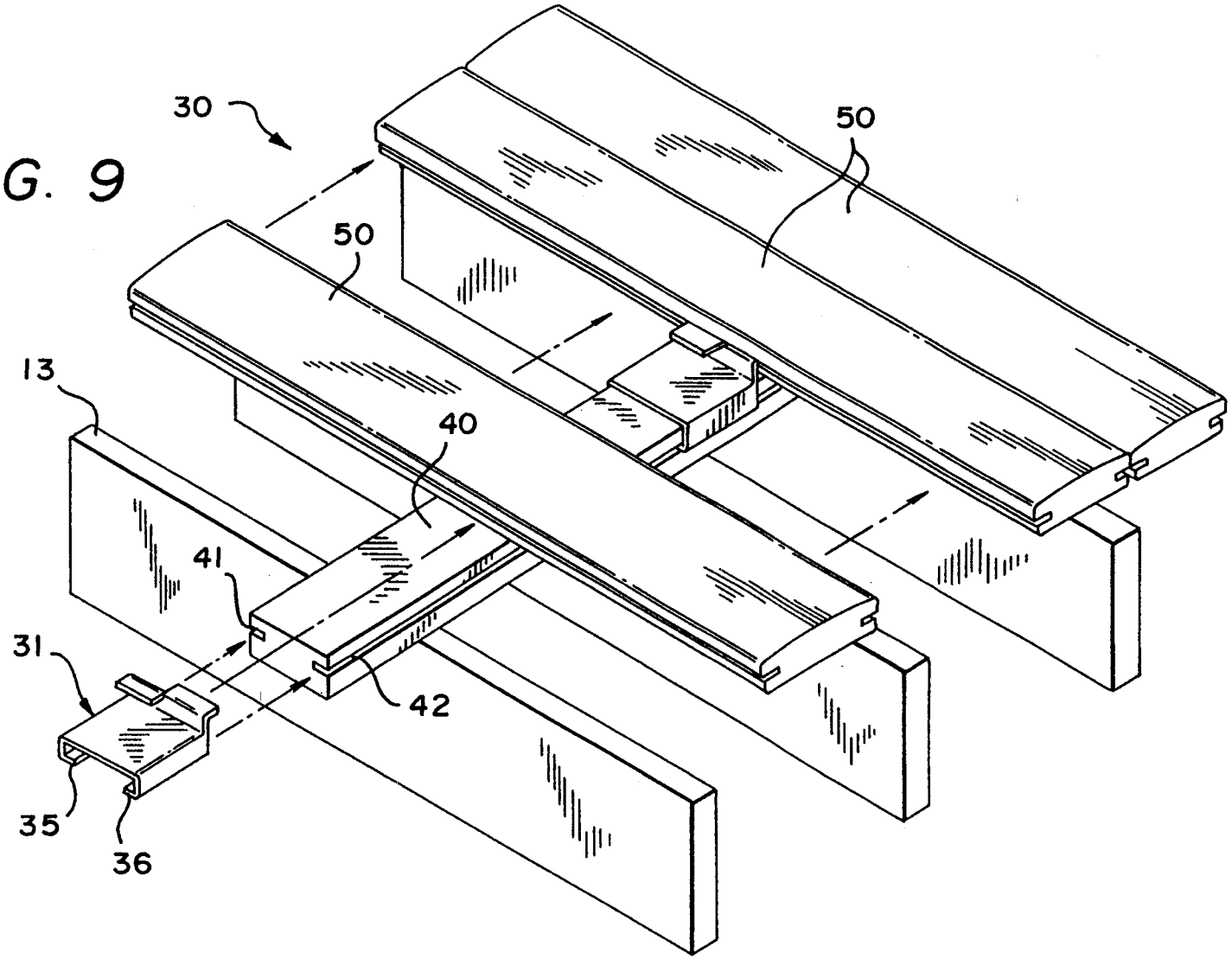
FIG. 9 is an exploded, fragmentary perspective view of a portion of deck constructed using a different embodiment of clip.

Alternatively, as shown in FIG. 8, the clips may be oriented on the supporting surface so that the boards extend diagonally rather than orthogonally to the support.

A modification of the invention is indicated generally at 30 in FIGS. 9–13. In this form of the invention, the clip 31 comprises a generally U-shaped body 32 having a pair of depending walls 33 and 34 along opposite sides terminating at their lower edges in a pair of inwardly turned, coplanar, opposed securing flanges 35 and 36. An upstanding wall 37 projects upwardly from one end of the body and terminates at its upper edge in a pair of coplanar, oppositely directed retaining flanges 38 and 39. As seen, the longitudinal dimension of the flanges 38 and 39 extends perpendicularly to the longitudinal dimension of the flanges 35 and 36, and the respective pairs of flanges lie in spaced apart, parallel planes.

As seen in FIG. 11, clip 31 is used with a stringer 40 that is secured transversely on top of the floor joists 13. The stringer may comprise a length of 2×4 dimension lumber, if desired, having longitudinally extending slots 41 and 42 formed in the opposite side edges thereof for slidably receiving the inturned flanges 35 and 36 on the clip 31, whereby the flanges 38 and 39 extend longitudinally with respect to the stringer in spaced relationship above it.

Decking boards 50 also have longitudinally extending slots 51 and 52 formed in their opposite side edges, and are placed transversely on top of a plurality of parallel, spaced apart stringers so that one of the flanges 38 and 39 on the clip is received in a respective slot of the decking board, thereby holding the decking boards to the stringers and thus to the floor joists. See FIGS. 11–13.

It should be noted that the clips 31 may slide longitudinally on the stringers, even after assembly of a plurality of decking boards on the supporting structure. Consequently, the boards may be moved in an edgewise direction to tighten the joints between them. This feature enables the joints between adjacent boards to be tightened or closed after the boards have dried out and shrunk following construction of a deck flooring surface.

Rather than use a stringer as shown in FIG. 11, the clip 31 may be sized to fit over the upper edge of a floor joist so that the decking boards may be secured directly on the joists. In this event, appropriate grooves would be routed into the upper edge portion of the joist.

When the clips are used outdoors, such on an exterior deck, they may be made of galvanized metal or other suitable material such as plastic. Other materials may be used in their construction, depending upon the desired use.

Further, the boards illustrated and described herein are especially adapted for use as exterior decking boards and may be suitably chemically treated for weather resistance. Additionally, the boards preferably have a unique cross-sectional configuration to facilitate shedding of water and to aid in treating and drying the boards during and after manufacture. For instance, the top surface of the boards have a convex curvature to promote run-off of water, and the curvature is selected in relation to the width of the boards so that they are comfortable to walk and stand on. In one example, the boards have a width of about five inches, a thickness of about one and three-eighths inches and a radius of curvature of the convex top surface of about twenty four inches. It should be understood, however, that the boards need not have any particular shape in order to incorporate the features of the invention disclosed herein, and may consist of otherwise conventional rectangular boards, such as 2×4 or 2×6 dimension lumber.

It will be noted that the grooves formed in the bottom surface of the boards not only serve to provide stress relief but also function to facilitate the drying process of the boards by providing a greater surface area and defining spaces for circulation of air when the boards are stacked.

In a specific example of the invention, the boards have a width, thickness and radius of curvature on the top surface as discussed above. In addition, the slots 24 and 25 in that form of the invention shown in FIGS. 1–8 are spaced inwardly from the respective side edges by a distance of about one and one-quarter inches, are seven-sixteenths of an inch wide, and are about nine-sixteenths of an inch deep. The clips 11 and 17 are about one and one-half inches long, one-half inch high and one-half inch wide at the outer ends of the barbs. Thus, with reference to FIGS. 4 and 5, dimension "a" would be seven-sixteenths of an inch, dimension "b" would be nine-sixteenths of an inch, and dimensions "c" and "d" would each be one-half inch. Dimension "W" would be five inches, dimension "$t_1$" would be one and one-quarter inches, dimension "$t_2$" would be one and one-eighth inches, dimension "e" would be one and one-quarter inches, and dimension "R" would be twenty-four inches. The top and bottom corners of the board have a one-quarter inch radius of curvature, and the edges formed by the slots 24 and 25 may have a one-eighth inch radius of curvature.

If desired, a construction adhesive may be placed in the grooves 24 and 25 or on the barbs of the clip 31 to effect a more secure connection and insure that the board does not work loose from the clip over a period of time.

While the invention has been illustrated and described in detail herein, it is to be understood that various modifications may be made therein without departing from the spirit and scope of the invention, as defined by the appended claims.

What is claimed is:

1. A flooring construction system, comprising:

an assembly clip having means to secure it to a surface of a support structure, said clip having oppositely laterally directed barbs thereon; and at least one flooring board having at least one longitudinally extending groove in a bottom surface thereof in a position to receive the barbs of said clip when the board is placed over said clip and pressed downwardly against said clip, whereby the board will be held to the support structure by engagement of the barbs of said clip in said groove, without requiring the use of separate fasteners extended through said board.

2. A construction system as claimed in claim 1, wherein:

said clip comprises an elongate body having opposite sides and at least one barb extending along each side; and said means for securing the clip to the support structure comprises at least one opening formed in the elongate body for receiving a fastener therethrough.

3. A construction system as claimed in claim 2, wherein:

a plurality of barbs extend along each side of the clip.

4. A construction system as claimed in claim 3, wherein:

the clip is formed of metal.

5. A construction system as claimed in claim 3, wherein:

the clip is formed of plastic.

6. An assembly clip for securing a first construction member to a second construction member, wherein the first construction member has at least one elongate groove formed in one surface thereof, said clip comprising:

an elongate body having opposite sides;

means for securing the clip to the second construction member; and a plurality of elongate barbs extending along each of the opposite sides of the clip and adapted to fit tightly into the groove in the first construction member to hold the first construction member to the clip and thus to the second construction member.

7. An assembly clip as claimed in claim 6, wherein:

the clip comprises a one-piece metal member.

8. An assembly clip as claimed in claim 6, wherein:

the clip comprises a one-piece plastic member.

9. A decking board for use in constructing a deck floor, said decking board having a top surface, a bottom surface and opposite side edges, said top surface being convex and manufactured with a radius of curvature that is approximately five times as great as the width of the board so that it will shed water and at the same time will present a comfortable surface upon which to walk and stand, and said bottom surface having at least one longitudinally extending recess formed therein to relieve stress and assist in preventing cupping or warping of the board while also defining a space through which air Can circulate when a plurality of the boards are stacked on top of one another to facilitate drying of the boards.

10. A decking board as claimed in claim 9, wherein:

there are two parallel, longitudinally extending grooves in the bottom surface of the board, extending throughout the length of the board.

11. A decking board as claimed in claim 10, wherein:

the board has a width of about five inches and the convex top surface has a radius of curvature of about twenty-four inches.

12. The method of constructing a flooring surface that has a plurality of flooring boards with an exposed top surface and a bottom surface secured to an underlying support structure, with the exposed top surface of the flooring boards being free of fasteners extended therethrough, comprising the steps of:

attaching a plurality of assembly clips to the support structure, with each clip having retaining means extended above the support structure;

providing recess means in each of the flooring boards in a location other than the top surface thereof;

positioning a flooring board above the assembly clips with the retaining means on the clips aligned with the recess means on the board;

pressing the flooring board downwardly toward the assembly clips so that the retaining means on the clips extend into the recess means and grip the board to hold it against the support structure; and repeating the steps for succeeding boards, with succeeding boards disposed in abutting, side-by-side relationship to one another to form an uninterrupted flooring surface.

* * * * *